US009358570B2

(12) United States Patent
Hickman

(10) Patent No.: US 9,358,570 B2
(45) Date of Patent: Jun. 7, 2016

(54) VISCOUS MATERIAL WARMING DEVICE

(71) Applicant: Philip Hickman, Wellsville, KS (US)

(72) Inventor: Philip Hickman, Wellsville, KS (US)

( * ) Notice: Subject to any disclaimer, the term of this patent is extended or adjusted under 35 U.S.C. 154(b) by 128 days.

(21) Appl. No.: 14/450,504

(22) Filed: Aug. 4, 2014

(65) Prior Publication Data

US 2016/0030969 A1 Feb. 4, 2016

(51) Int. Cl.
*B67D 7/80* (2010.01)
*B05C 5/00* (2006.01)

(52) U.S. Cl.
CPC ..... *B05C 5/001* (2013.01); *B05C 5/002* (2013.01)

(58) Field of Classification Search
CPC ..... B05C 5/001; B05C 5/002
USPC ..... 222/146.2, 146.1, 129, 593; 220/592.01, 592.05, 592.2, 592.21, 220/592.22, 592.28; 206/1.8, 1.9
See application file for complete search history.

(56) References Cited

U.S. PATENT DOCUMENTS 5,441,702 A * 8/1995 Lemieux ..... B65D 71/70 206/499
7,934,465 B1 * 5/2011 Brinker ..... B05C 5/027 118/302
9,010,569 B1 * 4/2015 Estrada ..... A61J 9/06 206/523
9,055,841 B2 * 6/2015 Coffey ..... A47J 36/28
2009/0193837 A1 * 8/2009 Hamlin ..... F25D 3/08 62/457.5
2011/0240656 A1 * 10/2011 Widitora ..... B65D 7/36 220/592.01
2013/0043191 A1 * 2/2013 Park ..... C12N 15/1003 210/695
2014/0083414 A1 * 3/2014 Ruiz ..... F24J 2/46 126/612
2014/0353190 A1 * 12/2014 Okihara ..... A61M 5/002 206/370
2015/0375924 A1 * 12/2015 Rodriguez ..... B65D 85/60 220/592.01
2016/0023833 A1 * 1/2016 Hallab ..... B65D 81/18 220/592.22

* cited by examiner

*Primary Examiner* — Lien Ngo
(74) *Attorney, Agent, or Firm* — The Law Office of Jerry D. Haynes

(57) ABSTRACT

A viscous material warming device comprising a housing, where the housing is surrounded with an insulated wall; a lid atop the housing; an upper plate mounted within the housing, where the upper plate includes a plurality of upper receiving holes each to accept a material tube, and where the upper plate includes spacer holes; a lower plate mounted within the housing below the upper plate, where the lower plate includes a plurality of lower receiving holes each to accept a tip of the material tube, and where the lower plate includes spacer holes; at least three spacers positioned between the upper plate and the lower plate, where the spacers are positioned within the spacer holes of each the upper plate and the lower plate; and a heater positioned within the lower plate, where the heater includes a thermometer to maintain the housing at a constant temperature.

12 Claims, 1 Drawing Sheet

VISCOUS MATERIAL WARMING DEVICE

BACKGROUND OF THE INVENTION

1. Field of the Invention

The present invention relates to a device to assist workers to maintain the viscosity of adhesives and sealants while working on a job site.

2. Description of Related Art

Adhesives and sealants are routinely used on construction sites, and home renovations. The adhesives are typically used to fuse two surfaces together, creating a practically permanent bond. For example, adhesives may attach a light fixture, or secure the carpet or pad to the floor. Some adhesives are simply applied and dried, while others must be mixed or heated to create the bond. Sealants are used as a barrier to prevent air, gas or liquid from passing through an object. For example, sealants are often used around pipe joints, or along bathroom fixtures to prevent water or gas from escaping the pipes and waterproof appliances. Both of these materials are usually found in a liquid or putty form that once applied hardens to create the bond for which it was purposed.

A common problem experienced while working with adhesives and sealants is that they harden too quick or before the worker is able to apply them to the surface. This may be due to old material, excess air exposure, or cold temperatures. Especially during the winter months, working with these bonding materials is problematic. The task must be performed very quickly upon exposure of the cold air, or the material simply does not dispense because it is practically frozen within the container. To address this problem, some people use materials like heating blankets to wrap the adhesive and sealant containers thereby keeping the materials warm between uses. While these heating blankets and bags maintain a warm temperature around the material, they have no structural integrity to maintain the sealant containers in an ideal upright position for easy dispensing during use.

Therefore it would be beneficial in the art to provide a device to warm sealants and adhesives while working outdoors. It would also be desirable in the art to provide a device that keeps the sealant containers in a position ideal for dispensing.

SUMMARY OF THE INVENTION

In view of the foregoing disadvantages inherent in the prior art, the general purpose of the present invention is to provide a viscous material warming device to warm adhesive tubes, configured to include all of the advantages of the prior art, and to overcome the drawbacks inherent therein.

Accordingly, an object of the present invention is to provide a viscous material warming device including a housing where the housing is heated and insulated to warm a plurality of material tubes.

Another object of the present invention is to provide a viscous material warming device with a pair of plates to hold the material tubes upright within the housing.

To achieve the above objects, in an aspect of the present invention, a viscous material warming device is described comprising a housing, where the housing is surrounded with an insulated wall; a lid atop the housing; an upper plate mounted within the housing, where the upper plate includes a plurality of upper receiving holes each to accept a material tube, and where the upper plate includes spacer holes; a lower plate mounted within the housing below the upper plate, where the lower plate includes a plurality of lower receiving holes each to accept a tip of the material tube, and where the lower plate includes spacer holes; at least three spacers positioned between the upper plate and the lower plate, where the spacers are positioned within the spacer holes of each the upper plate and the lower plate; and a heater positioned within the lower plate, where the heater includes a thermometer to maintain the housing at a constant temperature.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DRAWINGS

The present invention relates to a device to assist workers to maintain the viscosity of adhesives and sealants while working on a job site. The present invention provides a viscous material warming device to offer an insulated, heated container for materials like adhesives and sealants when used in cold environments like an outdoor construction site. The viscous material warming device includes an insulated housing that is heated internally to an ideal and consistent temperature. The interior of the container includes multiple chambers to receive adhesive tubes. A thermostat is incorporated into the interior to maintain the temperature thereby keeping the adhesive tubes viscous while working. The viscous material warming device prolongs the amount of work that can be done on a cold job site by preserving the bonding qualities of the adhesives.

Figure 1:
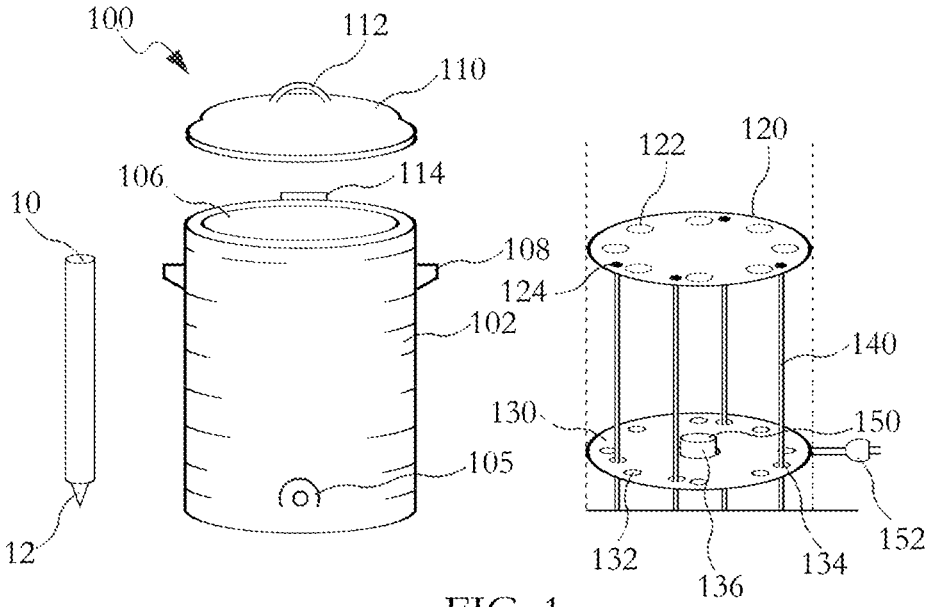
FIG. 1 depicts a perspective view of an viscous material warming device in accordance with an exemplary embodiment of the present invention.

Turning now descriptively to the drawings, referring to FIG. 1, a perspective view of a viscous material warming device 100 is shown in accordance with an exemplary embodiment of the present invention. The viscous material warming device 100 includes a housing 102 completely surrounded by insulated walls 104. The housing 102 includes an opening 106 at a top portion to insert and retrieve a plurality of material tubes 10. The material tubes 10 may be filled with adhesive, bonding, sealant or the like. On an outer surface of the housing 102 may be a pair of handles 108 to assist in transporting and adjusting the housing 102 during use. On a lower portion of the housing 102 a resealable hole 105. The hole 105 may allow extra heat to be released without having to opening the opening 106. Alternatively, the hole 105 may enable an electrical cord 152 to exit from the housing 102.

The housing 102 additionally includes a lid 110. The lid 110 closes the housing 102 to maintain an elevated temperature while using the viscous material warming device 100. The lid 110 is also insulated and includes a handle 112 to facilitate lifting and closing. The lid 110 may be completely removable, or it may be attached on a hinge 114. The housing 102 may be made from plastic or Styrofoam for portability. The housing 102 may be cylindrical (as shown) or it may be cubed with a coordinating circular or rectangular lid 110.

Within the housing 102 a pair of plates 120, 130 are mounted with a set of spacers 140. The plates 120, 130 and spacers 140 are illustrated outside the housing 102 for simplicity, but they are positioned within the insulated walls 104 of the housing 102 during use. An upper plate 120 is positioned above a lower plate 130. The upper plate 120 and the lower plate 130 may be circular or rectangular depending on the likes and preferences of the user, and depending on the shape of the housing 102.

The upper plate 120 includes a plurality of receiving holes 122 positioned round the perimeter of the upper plate 120. Positioned between the plurality of receiving holes 122 are a set of spacer holes 124. The spacer holes 124 receive an upper portion of the spacer 140 to secure the upper plate 120 in place. The lower plate 130 includes a plurality of receiving holes 132; one lower receiving hole 132 per upper receiving hole 122. The lower receiving holes 132 are smaller than the upper receiving holes 122. The upper receiving hole 122 enables the material tube 10 to pass while the lower receiving hole 132 accepts a tip 12. The lower receiving hole 132 is large enough to receive the tip 12, but smaller than the diameter of the material tube 10, therefore preventing the material tube 10 from passing through the lower plate 130. Like the upper plate 120, the lower plate 130 includes a set of spacer holes 134 to receive a lower portion of the spacer 140. There are preferably 3-4 spacer holes 124, 134 in each the upper and lower plates 120, 130.

The lower plate 130 may include a center hole 136 to brace a heater 150 within the housing 102. The heater 150 may comprise an internal thermostat to maintain the housing 102 at a consistent temperature. The heater 150 may be battery powered or it may include an electrical cord 152 that passes through the resealable hole 105 to plug into an external power source like a generator, a wall socket, a 12-Volt or vehicle battery, or the like.

Figure 1A:
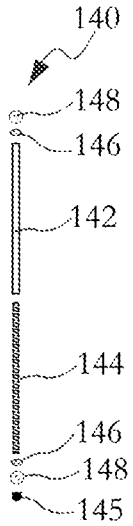
FIG. 1(A) depicts a perspective view of a spacer in accordance with an exemplary embodiment of the present invention.

Referring to FIG. 1A, the spacer 140 is illustrated in detail. The spacer 140 includes a sleeve 142 to receive a threaded bar 144. The sleeve 142 maintains the distance between the upper plate 120 and the lower plate 130 along the spacer 140. Each end of the spacer 140 includes a washer 146 and a nut 148 that is attached to each end of the threaded bar 144. The washer 146 and nut 148 secure the upper plate 120 above the sleeve 142 by fastening to the threaded bar 144 after passing through the upper receiving hole 124, and the lower plate 130 below the sleeve 142 by fastening to the threaded bar 144 after passing through the lower receiving holes 134. At a bottom portion of the spacer 140 may be a boot 145 to brace the threaded bar 144 to the floor of the housing 102.

Figure 2:
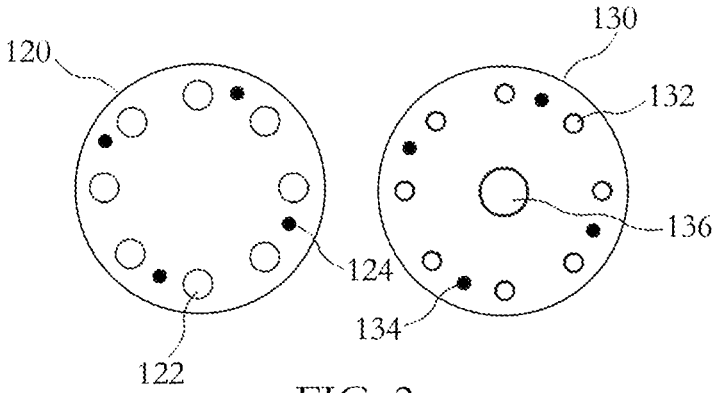
FIG. 2 depicts a top view of a pair of plates in accordance with an exemplary embodiment of the present invention.

Referring now to FIG. 2, a top view of the upper plate 120 and the lower plate 130 are shown. FIG. 2 illustrates the plates 120, 130 so that when the plates 120, 130 are overlapped the upper receiving hole 122 and upper spacer holes 124 directly align with the lower receiving holes 132 and lower spacer holes 134. This way the material tubes remain upright while inside the housing, thereby keeping them readily available for dispensing whenever needed by the user. 4-12 receiving holes 122, 132 may be positioned within the plates 120, 130. The plates 120, 130 may be made from plastic, aluminum, wood or the like, able to withstand elevated temperatures while still maintaining their structural integrity. The viscous material warming device 100 is ideal at worksites and jobs where the temperature drops below forty degrees. The viscosity of the sealants and adhesives are maintained allowing for more work productivity and less waste material.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

What is claimed is:

1. A viscous material warming device comprising:

a. a housing, where the housing is surrounded with an insulated wall;

b. a lid atop the housing, where the lid includes a handle;

c. an upper plate mounted within the housing, where the upper plate includes a plurality of upper receiving holes each to accept a material tube, and where the upper plate includes at least three spacer holes;

d. a lower plate mounted within the housing below the upper plate, where the lower plate includes a plurality of lower receiving holes each to accept a tip of the material tube, and where the lower plate includes at least three spacer holes;

e. at least three spacers positioned between the upper plate and the lower plate, where the spacers are positioned within the spacer holes of each the upper plate and the lower plate; and f. a heater positioned within the lower plate, where the heater includes a thermometer to maintain the housing at a constant temperature.

2. The viscous material warming device according to claim 1, where the spacer includes a sleeve to receive a threaded bar, where the sleeve separates the upper plate from the lower plate, and where threaded bar is positioned through the spacer holes of the upper plate and the lower plate, and where the threaded bar is secured at each end with a nut and a washer.

3. The viscous material warming device according to claim 2, where the spacer further includes a boot at a bottom portion of the threaded bar.

4. The viscous material warming device according to claim 1, where the upper plate and the lower plate maintain the material tube in an upright position with the tip facing downward.

5. The viscous material warming device according to claim 1, where the heater is battery powered.

6. The viscous material warming device according to claim 1, where the housing includes a resealable hole.

7. The viscous material warming device according to claim 6, where the resealable hole provides passage for an electrical cord on the heater to plug the heater into an external power source.

8. The viscous material warming device according to claim 1, where the lid is attached to the housing on a hinge.

9. The viscous material warming device according to claim 1, where the housing is cylindrical with a circular lid.

10. The viscous material warming device according to claim 1, where the housing is cuboidal with a rectangular lid.

11. The viscous material warming device according to claim 1, where the housing includes a pair of handles.

12. The viscous material warming device according to claim 1, where the lid is insulated.

* * * * *